United States Patent [19]

Röck et al.

[11] Patent Number: 4,848,860

[45] Date of Patent: Jul. 18, 1989

[54] DRAWER WITH METAL SIDE WALLS

[75] Inventors: Erich Röck; Josef Brunner, both of Höchst, Austria

[73] Assignee: Julius Blum Gesellschaft m.b.H., Höchst, Austria

[21] Appl. No.: 189,131

[22] Filed: Apr. 22, 1988

[30] Foreign Application Priority Data

May 4, 1987 [AT] Austria ..... 1102/87

[51] Int. Cl.[4] ..... A47B 81/00

[52] U.S. Cl. ..... 312/341.1; 312/330.1

[58] Field of Search ..... 312/330 R, 348, 341 NR

[56] References Cited

U.S. PATENT DOCUMENTS

| | | | |
|---|---|---|---|
| 747,685 | 12/1903 | Coye . | |
| 3,315,834 | 4/1967 | Nemlich | 312/330 R X |
| 3,321,253 | 5/1967 | Everburg . | |
| 3,432,061 | 3/1969 | Anderson | 312/330 R X |
| 3,726,579 | 4/1973 | Ullman | 312/330 R |
| 4,172,625 | 10/1979 | Swain . | |
| 4,392,696 | 7/1983 | Litchfield et al. . | |

FOREIGN PATENT DOCUMENTS 2190832 12/1987 United Kingdom .

*Primary Examiner*—Joseph Falk

*Attorney, Agent, or Firm*—Wenderoth, Lind & Ponack

[57] ABSTRACT

A drawer includes metal side walls and a front plate attached to the drawer side walls by holding devices. At least one strip of plastics material or the like is fastened to the outer side of each drawer side wall. Each strip covers an opening in the drawer side wall through which a screwdriver has access to the holding device for the front plate. Each strip has edge guide flanges held in guide grooves of the drawer side wall. The guide flanges are shorter than the strip, such that the strip thus has a free flap which can be pulled away from the drawer side wall. The flap has a projection which engages in the opening and forms a catch for the strip.

8 Claims, 3 Drawing Sheets

DRAWER WITH METAL SIDE WALLS

FIELD AND BACKGROUND OF THE INVENTION

The invention relates to a drawer with metal side walls to which a front plate is fastened by holding means, at least one strip of plastics material being fastened to the outer side of each drawer side wall and inserted into grooves of the drawer side wall, such grooves having lateral undercuts or beveled configurations.

Apart from the type of drawer which is manufactured as an integral piece, in particular drawers of plastics material, drawers are still frequently used which are assembled from various parts. Such drawers in most cases are provided with fittings which form a part of the pull-out guide assembly which facilitates extraction and insertion of the drawer from and into the body of the piece of furniture. Modern drawers further have holding means for the front plate which permit adjustment of the position of the front plate after mounting thereof in order to correct the alignment of the drawer with respect to the joints and the sides of the piece of furniture, when the drawer has already been inserted into the body of the piece of furniture.

Lately, metal drawer side walls have been used more frequently. The runner roller of a pull-out guide assembly which is at the side of the drawer can be mounted on such a metal drawer side wall, and also a pull-out flange of the pull-out guide assembly can be integrated in the drawer side wall. In particular in the case of drawers which are used in kitchens, living rooms, etc., it is necessary to coat the metal drawer side walls in view of their aesthetic appearance. A coating of plastics material is generally used since metal is generally considered as being too "cold". It has not been found that insufficient guiding of the drawer in the pull-out guide assembly causes high wear on the outer wall of the drawer where the latter is closest to the furniture side wall.

A drawer is known from U.S. Pat. No. 3,315,834 which has side walls of aluminum into which strips of plastics material are inserted.

SUMMARY OF THE INVENTION

It is an object of the invention to provide an improved drawer of the above-described type wherein the holding means for the front plate are completely covered but nevertheless easily accessible.

According to the invention this object is achieved in that the drawer side walls are double-walled, and that the strips which are displaceably held in the drawer side walls in guide grooves by means of guide flanges cover openings in the drawer side walls through which a screwdriver or the like has access to the holding means of the front plate, and in that the guide flanges are shorter than the strips so that each strip has a free flap which can be pulled away from the drawer side wall, such flap having a projection or nose which engages in the opening of the drawer side wall, when the strip is pushed over the opening, and abuts on a rear edge of the opening.

The arrangement according to the invention eliminates unintentional displacement of the strips, but nevertheless permits the strips easily to be moved when necessary. The strips should be relatively narrow and the plastics material should be relatively rigid to obtain good guiding of the sliding movement of the strips along the grooves. Bending of the strips is therefore impossible or occurs only to a very limited extent.

The strips can be pushed over the openings in the drawer side walls, after the front plate has been precisely adjusted, and then the strips completely cover the holding means of the front plate. Thus, the aesthetic appearance of the drawer is improved and furthermore dust is prevented from entering into the parts of the holding means of the front plate.

BRIEF DESCRIPTION OF THE DRAWINGS

In the following two embodiments of the invention will be described in more detail with reference to the accompanying drawings, in which.

DESCRIPTION OF THE PREFERRED EMBODIMENTS

The structural parts of the drawer according to the invention are front plate 1, wall 2, bottom 3 and two drawer side walls 4 which, according to the invention, preferably of aluminum.

Figure 3:
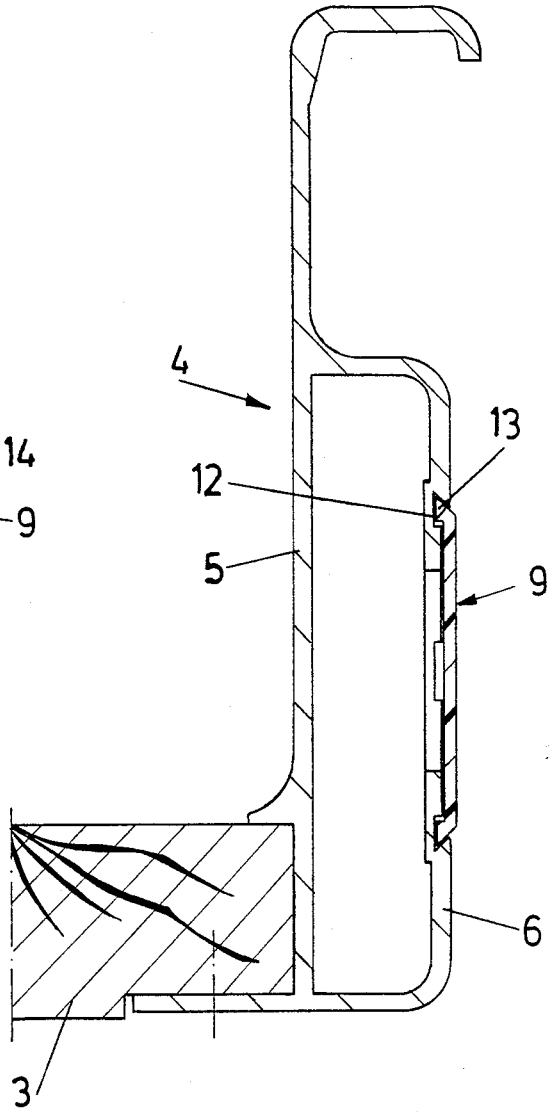
FIG. 3 is a cross-sectional view of the drawer side wall.
Figure 4:
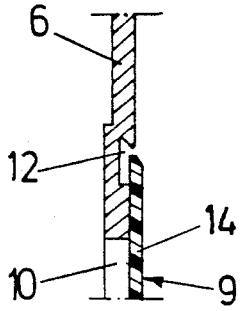
FIG. 4 is a cross-sectional view, taken along line IV—IV of FIG. 2, of the outer wall of the drawer side wall in the region of a guide groove.

As can be seen from the drawings, the metal drawer side walls 4 are of double-wall construction, each having an inner wall 5 and an outer wall 6. The outer wall 6 in the illustrated embodiment is provided with a longitudinal groove 7. As shown in FIGS. 3 and 4, lateral guide grooves 12 are arranged at both sides of the groove 7, i.e. along upper and lower edges thereof. Each guide groove 12 has an undercut portion, e.g. inwardly beveled, and extends over the full length of the drawer side walls 4.

Figure 1:
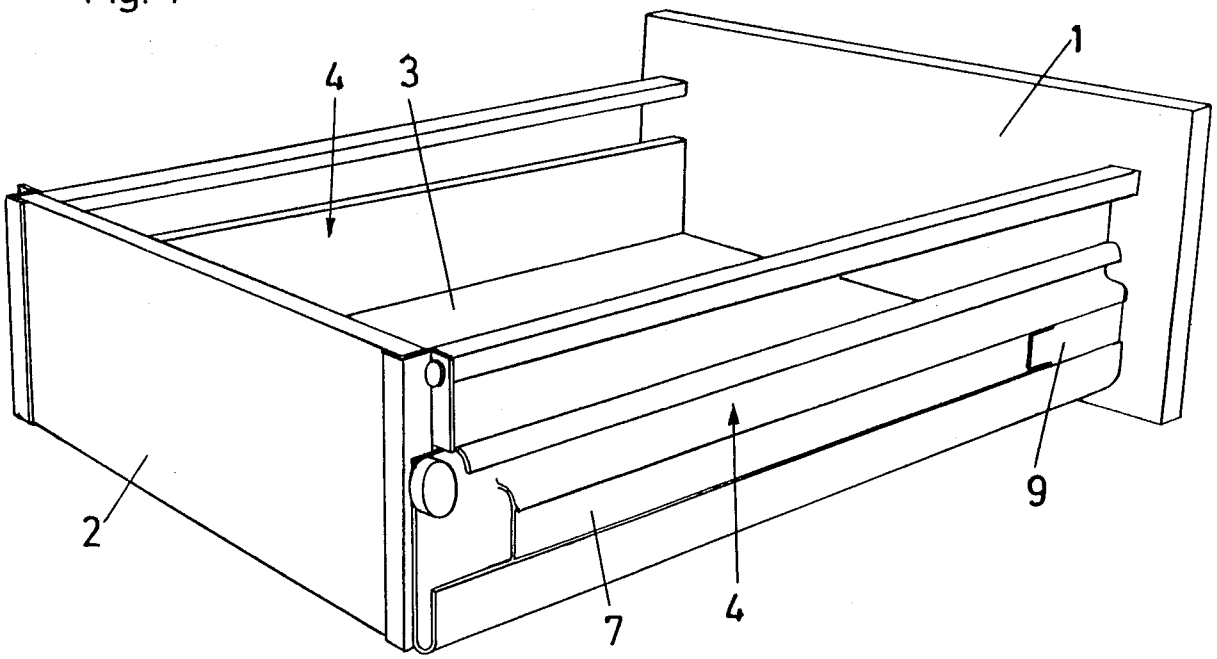
FIG. 1 is a perspective view of a drawer according to the invention.
Figure 5:
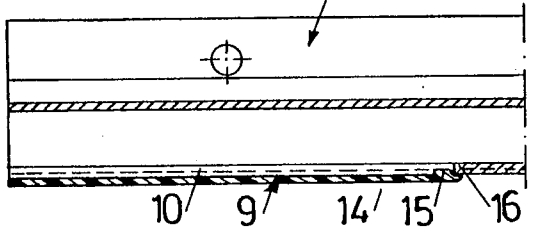
FIG. 5 is a longitudinal sectional view of the drawer side wall with a opening thereof being covered.

A strip 9 of plastics material is held in each groove 7 by means of beveled edge guide flanges 13 fitting into guide grooves 12. Each strip 9 covers, as can be seen in FIGS. 1, 2 and 5, an opening 10 in outer wall 6 through which an adjusting tool may have access to a means for attaching the wall 4 to the front plate 1.

Figure 2:
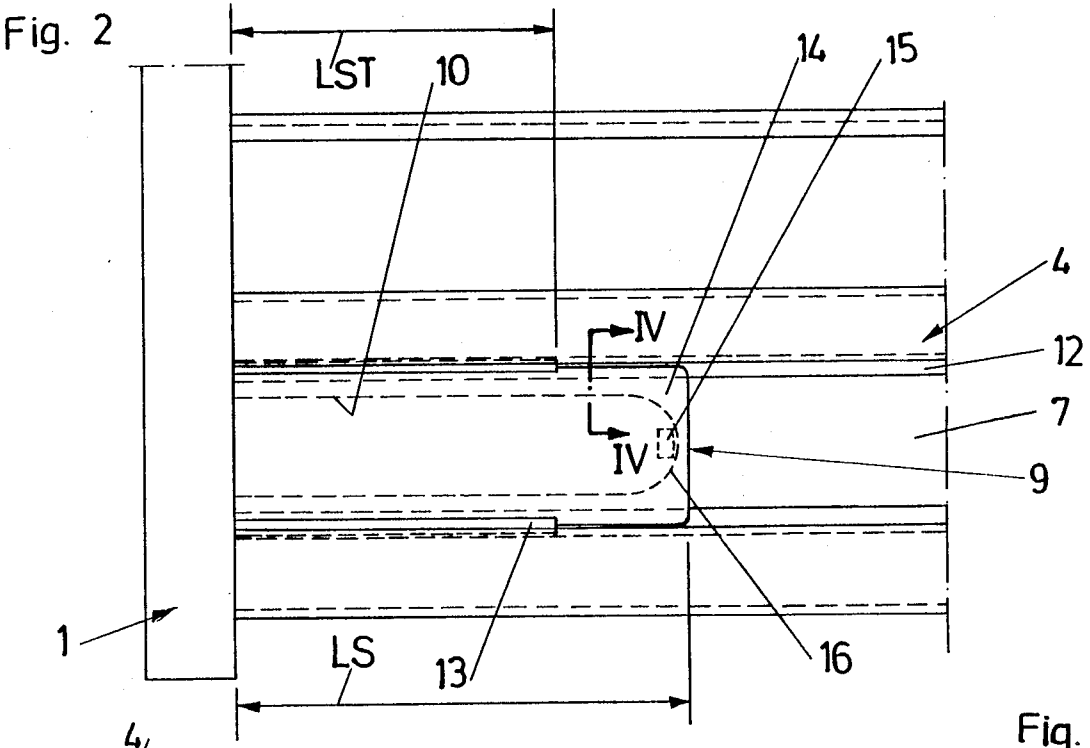
FIG. 2 is a side view of the front end of a drawer side wall.
Figure 6:
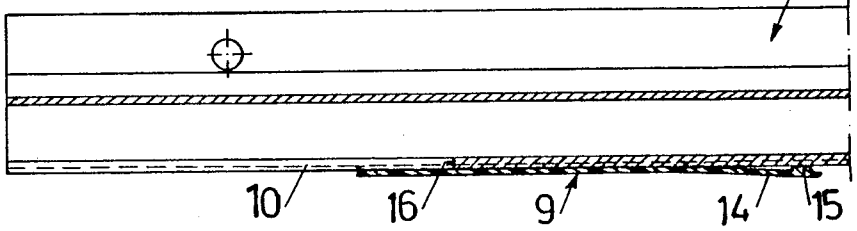
FIG. 6 is a sectional view similar to FIG. 5, but with the strip being rearwardly displaced.

As can particularly be seen from FIG. 2, the length LS of strip 9 is substantially greater than the length LST of the guide flanges 13 thereof. Hence, each strip 9 has a flap 14 that is free from lateral guiding when strip 9 covers the opening 10. Flap 14 is provided with a nose or projection 15 on its inner side. The nose 15 projects into the opening 10 when opening 10 is covered by strip 9 and abuts on a rear edge 16 of the opening 10. Due to the elasticity of the plastics material of the strip 9, nose 15 is held in the opening 10. Unintentional displacement of the strip 9, the front edge of which abuts on the front plate 1 of the drawer, is therefore avoided.

The strip 9 nevertheless easily can be moved rearwardly because it is possible to lift the flap 14 from the opening 10, since the flap 14 is not held at the drawer side wall by the guide flanges 13. When the strip 9 thereafter is pushed forwards, the nose 15 engages automatically behind the edge 16 of the opening 10 because of the elasticity of the plastics material.

The strips 9 may further be provided with an emblem, for example the name of the furniture manufacturer.

Since the strips 9 can be inserted into the drawer side walls 4 after the assembly of the drawer, it is possible to adapt the color of the strips to the piece of furniture and to the front plate 1.

We claim:

1. In a drawer including opposite metal side walls and a front plate connected to front ends of said side walls, each said side wall having a double wall construction including inner and outer walls, said outer wall having adjacent said front end thereof an opening providing access to holding means for connecting said front plate to said side wall, said outer wall having therein a longitudinal, inwardly directed groove, said opening being located within said groove, and a longitudinal strip of plastic material mounted within said groove and covering said opening, the improvement wherein:

said groove has opposite edges defined by undercut guide grooves, and said strip has at opposite edges thereof guide flanges fitting within respective said guide grooves, whereby said strip is longitudinally slidable relative to said side wall between positions covering and uncovering said opening;

said guide flanges having a length shorter than the length of said strip, thereby defining a free end flap that is manually bendable away from said side wall to enable said strip to be manually displaced between said positions; and said free end flap having an inwardly directed projection that, when said strip is in said covering position, extends into said opening and abuts an edge of said opening.

2. The improvement claimed in claim 1, wherein said guide grooves are inwardly beveled.

3. The improvement claimed in claim 1, wherein said guide grooves extend continuously throughout the entire length of said outer wall.

4. The improvement claimed in claim 1, wherein said projection abuts the rear edge of said opening.

5. In a metal side wall for use on each of opposite sides of a drawer and having a front end to be connected to a drawer front plate, said side wall having a double wall construction including inner and outer walls, said outer wall having adjacent said front end thereof an opening providing access to holding means for connecting said side wall to the front plate, said outer wall having therein a longitudinal, inwardly directed groove, said opening being located within said groove, and a longitudinal strip of plastic material mounted within said groove and covering said opening, the improvement wherein:

said groove has opposite edges defined by undercut guide grooves, and said strip has at opposite edges thereof guide flanges fitting within respective said guide grooves, whereby said strip is longitudinally slidable relative to said side wall between positions covering and uncovering said opening;

said guide flanges having a length shorter than the length of said strip, thereby defining a free end flap that is manually bendable away from said side wall to enable said strip to be manually displaced between said positions; and said free end flap having an inwardly directed projection that, when said strip is in said covering position,extends into said opening and abuts an edge of said opening.

6. The improvement claimed in claim 5, wherein said guide grooves are inwardly beveled.

7. The improvement claimed in claim 5, wherein said guide grooves extend continuously throughout the entire length of said outer wall.

8. The improvement claimed in claim 5, wherein said projection abuts the rear edge of said opening.

* * * * *